US005735011A

United States Patent [19]

Asher

[11] Patent Number: 5,735,011

[45] Date of Patent: Apr. 7, 1998

[54] PLAQUE REMOVING TOOTHBRUSH

[76] Inventor: Randall S. Asher, 8756 S. Aberdeen Cir., Highlands Ranch, Colo. 80126

[21] Appl. No.: 751,388

[22] Filed: Nov. 19, 1996

[51] Int. Cl.[6] ..... A46B 9/04

[52] U.S. Cl. ..... 15/167.1; 15/110; 15/207.2; 15/DIG. 6

[58] Field of Search ..... 15/110, 111, 114, 15/167.1, 188, 207.2, DIG. 6; 601/141

[56] References Cited

U.S. PATENT DOCUMENTS

| | | | |
|---|---|---|---|
| 564,497 | 7/1896 | Babis . | |
| 1,128,139 | 2/1915 | Hoffman | 15/111 |
| 1,694,636 | 12/1928 | Barker . | |
| 2,702,914 | 3/1955 | Kittle | 15/110 |
| 3,007,441 | 11/1961 | Eyer . | |
| 3,103,027 | 9/1963 | Birch . | |
| 3,133,546 | 5/1964 | Dent . | |
| 3,230,562 | 1/1966 | Birch . | |
| 3,717,898 | 2/1973 | Jones . | |
| 3,985,147 | 10/1976 | Ricketts et al. . | |
| 4,288,883 | 9/1981 | Dolinsky | 15/110 |
| 4,571,768 | 2/1986 | Kawashima . | |
| 5,040,260 | 8/1991 | Michaels . | |
| 5,337,436 | 8/1994 | Saxer et al. . | |
| 5,534,336 | 7/1996 | Nomura et al. . | |
| 5,604,951 | 2/1997 | Shipp | 15/110 |
| 5,678,275 | 10/1997 | Derfner | 15/167.1 |

OTHER PUBLICATIONS

Macklanburg–Duncan Brochure, Date unknown.

Henry Schein Dental '97–'97 Catalog, Sep. 15.—March 14.

*Primary Examiner*—Terrence Till

*Attorney, Agent, or Firm*—Klaas, Law, O'Meara & Malkin, P.C.; Joseph J. Kelly, Esq.

[57] ABSTRACT

A toothbrush capable of removing plaque from teeth wherein a plurality of plaque removing members formed from a mixture of a relatively soft elastomeric material and particles of an abrasive material project outwardly from a support portion of the toothbrush and each plaque removing member is surrounded by a plurality of tufts of bristles formed from conventional materials and wherein each plaque removing member has a base portion and a plurality of spaced apart projections with each projection having an outer surface with a plurality of crevices formed therein.

20 Claims, 1 Drawing Sheet

PLAQUE REMOVING TOOTHBRUSH

FIELD OF THE INVENTION

This invention relates generally to toothbrushes for the cleaning of human teeth and relates specifically to a toothbrush for the cleaning of human teeth that is provided with special plaque removing properties.

BACKGROUND OF THE INVENTION

Convention toothbrushes using a plurality of spaced apart tufts of bristles have been used for ages in the cleaning of human teeth. The bristles have been formed from various materials that have been classified from hard to soft. However classified, a bristle remains a bristle. Several attempts have been made to improve these conventional toothbrushes. U.S. Pat. Nos. 3,103,027 and 3,230,562 disclose toothbrushes having conventional bristles with a plurality of gum massaging tips or wedges interspersed therewith. U.S. Pat. No. 4,571,768 discloses a toothbrush having conventional bristles and a plurality of resilient projecting elements interspersed therewith. Each projecting element comprises a hollow silicone rubber tube having one closed end with a magnet adjacent to the closed end and a thin synthetic resin piece is inserted into the hollow tube to improve the strength and resiliency thereof against bending. U.S. Pat. No. 5,040,260 discloses a toothbrush having a plurality of projections each formed from a thermoplastic elastomer. The inner projections are truncated cylinders with the free ends thereof of a beveled configuration. The outer projections have a conical configuration having a tip as the free end. U.S. Pat. No. 3,985,147 discloses an implement for removing stains and plaque from teeth and has a wheel formed from a hardened rubber, plastic or similar material with an abrasive material, such as Carborundum particles, pumice or the like embedded therein. As far as applicant is aware of, none of the above-described patented toothbrushes have been commercially successful.

BRIEF DESCRIPTION OF THE INVENTION

This invention provides a toothbrush for the cleaning of human teeth and removing the plaque therefrom wherein a plaque removing member or members are each surrounded by a plurality of conventional bristles, all of which project outwardly from a support portion of a conventional toothbrush handle.

In a preferred embodiment of the invention, a conventional toothbrush handle has a support portion having a plurality of spaced apart tufts of conventional bristles, formed from natural or synthetic materials, secured in and projecting outwardly from the support portion. At least one plaque removing member, preferably two or more plaque removing members, is secured to and projects outwardly from the support portion. Each plaque removing member is surrounded by a plurality of the spaced apart tufts of conventional bristles. Each plaque removing member is formed from a mixture of an elastomeric material, such as a silicone rubber, a thermoplastic elastomer or other materials having similar characteristics, and particles of an abrasive material, such as pumice or other materials having similar characteristics. The conventional bristles in the plurality of the spaced apart tufts preferably extend outwardly from the support portion for a distance greater than the distance that the plaque removal member or members project from the support portion.

In a preferred embodiment of the invention, the ratio in the mixture from which the plaque removing member is formed is between about 5.0 and 20.0 parts of the elastomeric material to 1.0 part of the abrasive material by volume. Also, the elastomeric material preferably is a silicone rubber such as that marketed by Macklanburg-Duncan under the trade designation SILICONE 100% Silicone Rubber Sealant and the abrasive material preferably comprises particles of pumice such as those marketed by HENRY SCHEIN under the trade designation flour, fine or medium. The plaque removing member may be formed by mixing the above-described preferred materials in a blender and then pressed into a mold and allowed to cure. However, since the wear of the plaque removal member or members is minimal, it may only be necessary to embed the abrasive materials into the exposed outer portion of the plaque removing member or members.

Each plaque removing member has a transverse cross-sectional area that is substantially larger than the transverse cross-sectional area of a tuft of the conventional bristles. Also, each plaque removing member preferably comprises a base portion secured to the support portion and a plurality of spaced apart projections extending outwardly from the base portion, which projections are preferably four in number. The outer surface of the combined projections preferably has a central portion recessed inwardly from an outer rim portion. The outer surface of each projection preferably has a plurality of crevices formed therein and some of the crevices may have a connecting portion. The longitudinal length of each projection may vary between about one-quarter of the overall length of the plaque removing member to about three-quarters of the overall length of the plaque removing member.

BRIEF DESCRIPTION OF THE DRAWINGS

Illustrative and presently preferred embodiments of the invention are illustrated in the accompanying drawing in which.

DETAILED DESCRIPTION OF THE INVENTION

Figure 1:
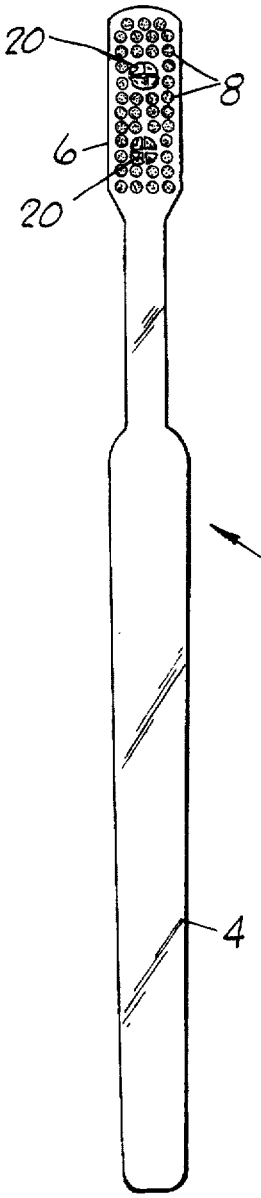
FIG. 1 is a top plan view of a toothbrush of this invention.
Figure 2:
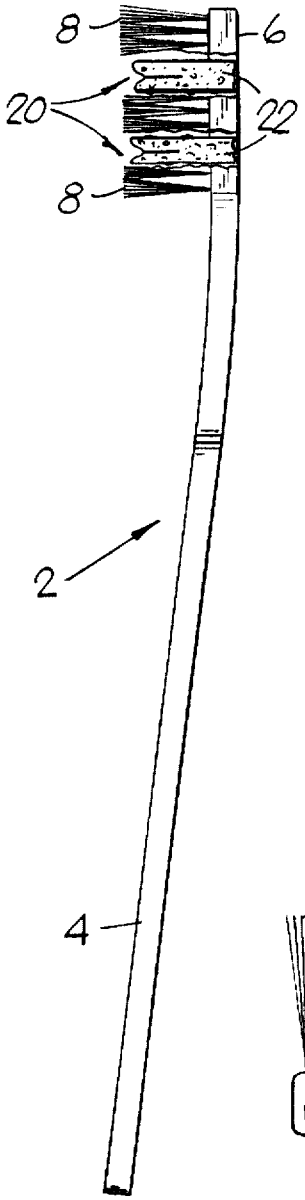
FIG. 2 is a side elevational view of FIG. 1 with parts removed.

In FIGS. 1 and 2, there is disclosed a toothbrush 2 of this invention which has a handle portion 4 and a support portion 6 formed from conventional materials. A plurality of tufts 8 of bristles formed from conventional materials are secured to and project outwardly from the support portion 6 and are in a spaced apart relationship.

Figure 3:
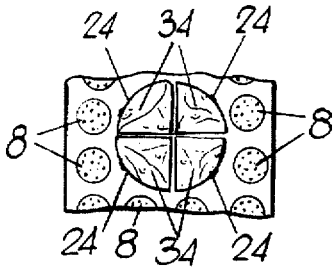
FIG. 3 is an enlarged top plan view of a portion of FIG. 1.
Figure 4:
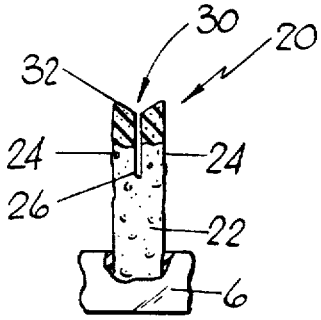
FIG. 4 is an enlarged side elevational view of a plaque removing member of this invention.
Figure 5:
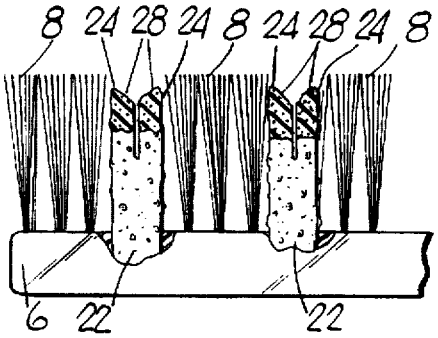
FIG. 5 is an enlarged side elevational view with parts removed of a portion of FIG. 1 of one preferred embodiment of the invention.
Figure 6:
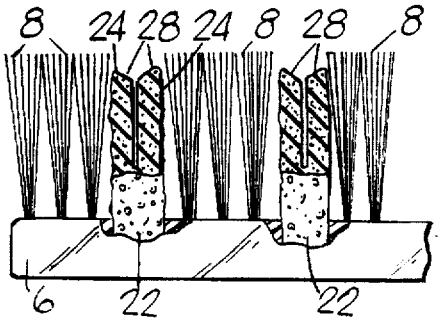
FIG. 6 is an enlarged side elevational view with parts removed of a portion of FIG. 1 of another preferred embodiment of the invention.

At least one and preferably two or more plaque removing members 20 have a base portion 22 which is secured to and projects outwardly from the support portion 6 and are each located to be surrounded by a plurality of the plurality of tufts 8 of bristles. Each plaque removing member 20 has a plurality of spaced apart projections 24 which are integral with and extend outwardly form the base portion 22. A groove 26 separates one projection 24 from another projection 24. Each projection 24 has a longitudinal length in the ratio of about 0.25 and 0.75 of the length of the plaque removing member 20 that extends from the support portion 6. Each projection 24 has an outer surface 28 which, when the four illustrated projections 24 are considered, has a central portion 30 that is recessed inwardly from an outer rim 32. The outer surface of each projection 24 has a plurality of crevices 34, FIG. 3, formed therein.

Each plaque removing member 20 is preferably formed from a mixture of a elastomeric material and an abrasive material. The elastomeric material preferably comprises a silicone rubber or a thermoplastic elastomer such as those described in U.S. Pat. No. 5,040,260. The abrasive material preferably comprises particles of pumice or Carborundum such as those described above in U.S. Patent No. 3,985,147. The ratio of the elastomeric material and the abrasive material, when the elastomeric material is a silicone rubber marketed by Macklanburg-Duncan and the abrasive material is pumice marketed by HENRY SCHEIN under the trade designation flour, is preferably in the range of between about 5.0 and 20.0 parts of the elastomeric material by volume to 1.0 part of the abrasive material by volume and preferably comprises 10.0 parts of the elastomeric material by volume to 1.0 part of the abrasive material by volume. The foregoing ratios are based on the procedure wherein the elastomeric material and the abrasive material are mixed together so that the particles of the abrasive material are generally evenly spaced apart in the elastomeric material. However, since the plaque removing material is subject to minimal wear, it may be possible to embed fewer quantities of the particles of the abrasive material into the outer surface portions of the plaque removing member that contacts the teeth and gums of the user while retaining the benefit of the mixture.

The toothbrush of this invention is used in a conventional manner. After applying toothpaste, the toothbrush is moved over the teeth while applying pressure thereto. The projections move away from each other and contact a wide surface area of each tooth. Each projection provide a wiping action on each tooth that combines with the abrasive particles to disrupt the plaque on each tooth. Since the projections are spread apart, this provides openings for the removal of the plaque from the cleaning area. The nature of the mixture of the elastomeric material and the particles of the abrasive material in the plaque removing member is such that the particles of the abrasive material have no deleterious effect on the teeth. While the illustrated shape of the plaque removing member is preferred, it is understood that it can be of other configurations.

It is contemplated that the inventive concepts herein described may be variously otherwise embodied and it is intended that the appended claims be construed to include alternative embodiments of the invention except insofar as limited by the prior art.

What is claimed is:

1. A toothbrush having a plurality of bristles supported on and projecting outwardly from a support portion of a conventional toothbrush handle in a spaced apart relationship which bristles are formed from conventional relatively hard materials comprising:

at least one plaque removing member supported on and projecting outwardly from said support portion;

said at least one plaque removing member surrounded by a plurality of said plurality of bristles;

said at least one plaque removing member being formed from a mixture of relatively soft elastomeric material and particles of an abrasive material.

2. A toothbrush as in claim 1 wherein:

said at least one plaque removing member comprises a plurality of plaque removing members.

3. A toothbrush as in claim 1 wherein:

said plurality of bristles project outwardly from said support portion for a distance greater than the distance said at least one plaque removing member projects from said support portion.

4. A toothbrush as in claim 3 wherein:

said mixture comprises between about 5.0 and 20.0 parts of said elastomeric material by volume to 1.0 part of said particles of an abrasive material by volume.

5. A toothbrush as in claim 4 wherein:

said thermoplastic elastomer is a silicone rubber; and said abrasive material is pumice.

6. A toothbrush as in claim 3 wherein:

said mixture comprises about 10.0 parts of said elastomeric material by volume to 1.0 part of said particles of an abrasive material by volume.

7. A toothbrush as in claim 6 wherein:

said elastomeric material is a silicone rubber.

8. A toothbrush as in claim 1 wherein:

said plurality of bristles comprises a plurality of spaced apart tufts of bristles with each tuft having a plurality of bristles each formed from a relatively hard material.

9. A toothbrush as in claim 8 wherein said at least one plaque removing member comprises:

a base portion secured to said support and projecting outwardly from said support; and a plurality of spaced apart projections outwardly extending outwardly from said base portion.

10. A toothbrush as in claim 9 wherein:

each of said projections having a transverse cross-sectional area substantially greater than the cross-sectional area of one of said plurality of bristles.

11. A toothbrush as in claim 10 wherein:

said at least one plaque removing member comprises a plurality of plaque removing members.

12. A toothbrush as in claim 11 wherein:

said plurality of bristles projecting outwardly from said support a distance greater than the distance each of said plurality of plaque removing members project outwardly from said support.

13. A toothbrush as in claim 12 and further comprising:

each of said projection having an outer surface; and said outer surface having a plurality of crevices formed therein.

14. A toothbrush as in claim 9 and further comprising:

each of said projections having an outer surface; and said outer surface having a plurality of crevices formed therein.

15. A toothbrush as in claim 9 wherein:

said at least one plaque removing member comprises a plurality of plaque removing members.

16. A toothbrush as in claim 15 wherein:

said mixture comprises between about 5.0 and 20.0 parts of said elastomeric material by volume to 1.0 part of said abrasive material by volume.

17. A toothbrush as in claim 15 wherein:

said mixture comprises about 10.0 parts of said elastomeric material by volume to 1.0 part of said abrasive material by volume.

18. A toothbrush as in claim 17 wherein:

said elastomeric material comprises a thermoplastic elastomer.

19. A toothbrush as in claim 17 and further comprising:

each of said projections having an outer surface; and said outer surface having a plurality of crevices formed therein.

20. A toothbrush as in claim 17 wherein:

said thermoplastic elastomer is a silicone rubber; and said abrasive material is pumice.

* * * * *